United States Patent [19]

McIntosh

[11] 4,442,940

[45] Apr. 17, 1984

[54] CONTAINER FOR USE IN STORING COUPONS

[76] Inventor: Burt H. McIntosh, 320 S. Boston #911, Tulsa, Okla. 74103

[21] Appl. No.: 430,938

[22] Filed: Sep. 30, 1982

[51] Int. Cl.[3] ..... B65D 85/00

[52] U.S. Cl. ..... 206/425; 220/18; 248/213.2

[58] Field of Search ..... 220/18, 23.4, 3.3; 206/425; 248/208 R, 295, 214, 260, 99

[56] References Cited

U.S. PATENT DOCUMENTS

| | | | |
|---|---|---|---|
| 496,243 | 4/1893 | Zenner | 220/18 |
| 3,907,104 | 9/1975 | Taub | 220/18 |
| 3,944,108 | 3/1976 | Enik | 220/18 |
| 3,983,976 | 10/1976 | Taylor | 220/18 |

FOREIGN PATENT DOCUMENTS

| | | | |
|---|---|---|---|
| 586021 | 12/1958 | Italy | 220/18 |

*Primary Examiner*—Joseph Man-Fu Moy

*Attorney, Agent, or Firm*—Head, Johnson & Stevenson

[57] ABSTRACT

A container for use in storing coupons between index cards, the container having a bottom portion with an open top and an upper portion with an open bottom, the portions being hinged together and dimensioned so that index cards received in the lower portion extend into the upper portion when the upper portion is closed, and pivotal support tabs attached to each of the bottom portion end walls and pivotal outwardly when the upper container portion is opened allowing the container to be supported on an upper ledge of a shopping cart.

2 Claims, 4 Drawing Figures

CONTAINER FOR USE IN STORING COUPONS

SUMMARY OF THE INVENTION

A modern merchandising technique is the provision of coupons offering a discount when used for the purchase of a product. These coupons are frequently published in newspapers, magazines, supplements, and so forth or are contained on or in packages of merchandise. Coupons are presently being offered for a wide variety of consumer products. Housewives saving coupons for future use have the problem of organizing them in such a manner as to know which coupons they have and to retain them in a way so that they will be readily available when needed at a merchant's checkout stand.

The present invention provides a convenient way to store and utilize coupons. The invention is a container dimensioned to receive index cards so that coupons can be stored in an indexed manner. The container includes a bottom portion and an upper portion. The bottom portion has a closed bottom and open top with a forward and rearward sidewall and end walls. The top portion is of the same cross-sectional dimension, having a closed top and open bottom with front and rearward sidewalls and end walls. The lower edge of the top portion rearward wall is pivoted to the upper edge of the bottom portion rearward wall so that the top portion can be pivoted to an open position, fully exposing the container bottom portion, or to a closed position.

The container upper and lower portions are dimensioned so that index cards are received in the lower portion and extend into the upper portion. When the upper portion is pivoted to the open position, the tops of the index cards are exposed to provide easy access to coupons, notes, or the like stored between the index cards.

An important aspect of the invention is the provision of means of supporting the container for use by a shopper employing a shopping cart. For this purpose, support tabs are fixed to the container bottom portion end walls and extend beyond the forward sidewall and form hooks which can engage the upper edge of a shopping cart. In a most preferred arrangement, these support tabs are pivotally affixed to the interior surface of the container lower portion end walls so that they can be pivoted inwardly and fully retained within the container upper portion when it is in a closed position. When the upper protion is in the open position, the support tabs can be pivoted forwardly to extend beyond the plane of the lower portion front sidewall to engage the upper edge of a shopping cart.

While the dimensions of the container may vary considerably, a preferred arrangement is that the container be of small external dimensions so that it can be carried in the purse of a shopper, yet of sufficient size so that the average coupons can be stored within the container without being folded.

DESCRIPTION OF THE DRAWINGS

FIG. 2 shows the support tabs extended in a forward position and in engagement with the upper edge of a shopping cart. In addition, FIG. 2 shows index cards and coupons as received within the container.

FIG. 4 does not show index cards or coupons received within the container so as to more fully disclose a preferred configuration of the support tabs.

DETAILED DESCRIPTION

Figure 4:
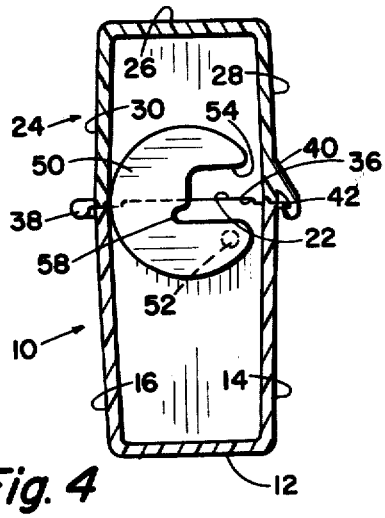
FIG. 4 is a cross-sectional view taken along the line 4—4 of FIG. 1.

Referring to the drawings, a container which employs the principles of this invention is illustrated. The container includes a lower portion 10 which has a closed bottom 12; a front sidewall 14; a rearward sidewall 16; end walls 18 and 20; and an open top 22.

An upper portion is generally indicated by the numeral 24 and in like manner includes a closed top 26; a front sidewall 28; a rearward sidewall 30; end walls 32 and 34; and an open bottom 36.

Figure 2:
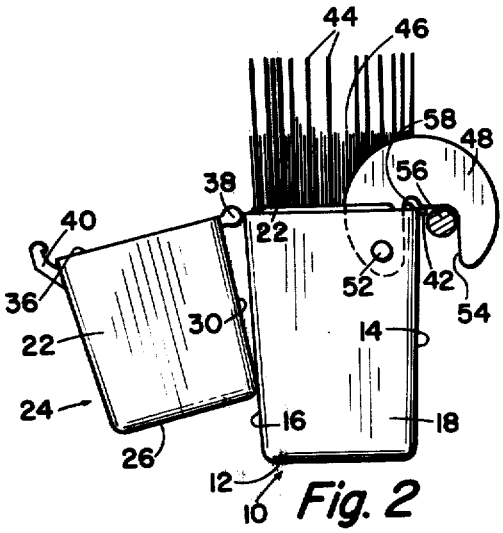
FIG. 2 is an end view of the container of FIG. 1 showing it in the open condition.
Figure 1:
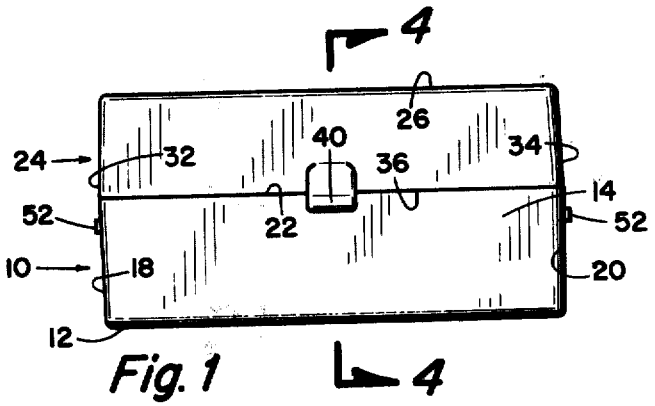
FIG. 1 is an external elevational view of a container embodying the principles of this invention, the container being shown in a closed position.
Figure 3:
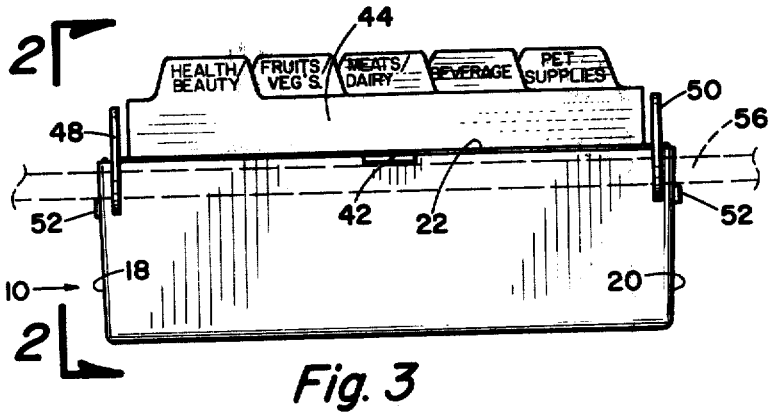
FIG. 3 is a front view as in FIG. 1, in somewhat larger dimensions, and showing the container in the open position wherein the upper portion is pivoted to fully expose the index cards. The support tabs are in the forward position and in engagement with the upper edge of a shopping cart.

The upper edge of the bottom portion rearward sidewall 16 and top portion rearward sidewall 30 are hinged at 38 so that the top can be pivoted to the closed position as shown in FIGS. 1 and 4 or to an opened position as shown in FIGS. 2 and 3.

To retain the closed position 24 in engagement with the lower portion 10, an integral latch 40 is formed with the top portion extending from the forward sidewall 28 and defining a hook which engages an externally extending lip 42 formed at the upper edge of the lower portion forward sidewall 14. A slight outward pressure on the latch 40 disengages it from lip 42 so that the top portion 24 may be opened.

The top and bottom portions are dimensioned to receive index cards 44 therein, the upper portion of the index cards extending above the bottom portion open top 22 so that when the top portion 24 is opened as shown in FIGS. 2 and 3 the index cards are readily available. Each of the index cards preferably includes a tab as illustrated categorizing the sections between the cards so that coupons 46, notes, or the like, may be placed between the cards.

An important provision of the invention is the provision of integral means so that the container may be attached to the upper edge of a shopping cart, making it readily accessible to the user. For this purpose, a first tab 48 and a second support tab 50 are utilized. In the preferred arrangement the support tabs are pivoted to the container lower portion end walls 18 and 20 and are preferably pivoted to the interior surface of the end walls. Each of the tabs 48 is formed of a thin, rigid material, such as plastic, and is affixed to an end wall by means of a pivot pin 52.

Each of the support tabs 48 and 50 is configured to provide a hook which is achieved such as by the provision of a recess or notch 54. The notch is dimensioned to receive the upper edge of a shopping cart which is exemplified by a rod 56 since most shopping carts are of the wire basket type. However, the rod 56 is not a part of the invention but is illustrated only to show the manner in which the invention is employed. The notch 54 may be configured to have an indentation portion 58 shown in FIGS. 2 and 4, so that when the support tabs are outwardly pivoted, the indentation portion 58 receives the upper edge of the lower portion front sidewall 14.

The dimensions of the container are preferably such that a shopper can retain the device in a purse or a coat pocket, yet is sufficiently large so that most coupons 46 may be retained between the index cards without folding.

The provision of the internally pivoted support tabs 48 and 50 means that the exterior of the container can be plain and unencumbered; yet, when the container is opened and in use, means is provided for attaching it to the upper edge of a device such as a shopping cart so that the contents are readily accessible to the user.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. A container for use in storing coupons, notes, and the like between index cards and providing means for supporting the container on the edge of a shopping cart or the like, comprising:

a container lower portion having a closed bottom, front and rearward sidewalls, end walls and an open top, a container upper portion having a closed top, front and rearward sidewalls, end walls and an open bottom;

the container upper portion rearward sidewall, being hinged to the lower container portion rearward sidewall whereby the upper portion can be pivoted to a closed position on the lower portion or pivoted to an open position in which the open tops of the upper and lower portions are exposed;

the lower and upper container portions being dimensioned to receive index cards therein, the upper portion of the cards extending into the container upper portion when the upper portion is in the closed position and the upper portion being dimensioned to receive coupons, notes and the like in a vertical manner when in an opened position;

a first support tab secured to one end wall of said container lower portion; and a second support tab secured to the other end wall of said container lower portion, the support tabs being of relatively thin planar configuration and pivotal in planes parallel said end walls, said tabs being pivotal forwardly of said container lower portion forward wall, and each support tab having means forming a hook to receive a support edge, such as the upper edge of a shopping cart, whereby the container may be supported with said bottom portion held uprightly and with said top portion hinged to the open position, the contents of the container lower portion, such as index cards, coupons, etc. being readily available for examination and retrieval and storable in the container opened top portion, said tabs being pivotal rearwardly to extend within said container lower and upper portions when said container upper portion is closed, the interior of said container lower portion being unencumbered to receive contents therein.

2. A container according to claim 1, including latch means to retain said container upper portion in closed position with said container lower portion.

* * * * *